US006776437B1

(12) United States Patent
Ho

(10) Patent No.: US 6,776,437 B1
(45) Date of Patent: Aug. 17, 2004

(54) FOLDER INDEX POCKET STRUCTURE

(75) Inventor: Chin-Lien Ho, Taichung (TW)

(73) Assignee: Danny & Hudson Inc., Taichung (TW)

( * ) Notice: Subject to any disclaimer, the term of this patent is extended or adjusted under 35 U.S.C. 154(b) by 0 days.

(21) Appl. No.: 10/615,869

(22) Filed: Jul. 10, 2003

(51) Int. Cl.[7] ..... B42F 21/00

(52) U.S. Cl. ..... 283/38; 40/641; 229/67.1; 281/15.1; 281/31; 283/36; 283/42

(58) Field of Search ..... 40/359, 360, 626, 40/641; 229/67.1; 281/15.1, 29, 31, 36–38, 51; 283/36–42

(56) References Cited

U.S. PATENT DOCUMENTS 3,537,728 A * 11/1970 Reese ..... 281/31
4,516,871 A * 5/1985 Leitman ..... 402/79
4,715,621 A * 12/1987 Colavito et al. ..... 283/36
4,932,520 A * 6/1990 Ciarcia et al. ..... 206/232
6,244,628 B1 * 6/2001 Muller ..... 283/38
6,511,246 B2 * 1/2003 Sapienza et al. ..... 402/79
6,632,042 B1 * 10/2003 Liener Chin et al. ..... 402/79

* cited by examiner

*Primary Examiner*—Monica S. Carter
(74) *Attorney, Agent, or Firm*—Birch, Stewart, Kolasch & Birch, LLP

(57) ABSTRACT

The present invention discloses a folder index pocket structure, comprising a main body for being used in a folder having a plurality of loose-leaf pages, and such main body is a thin plastic transparent plate using a front cover sheet and a back cover sheet on one side of the main body to define an index pocket for holding an index card; a folded edge is disposed at the bottom of the index pocket to receive the index card; and a through hole is disposed on the back cover sheet for letting a user push the index card into and out of the index card pocket by finger. By means of the marked numbers on the index card corresponding to the page number, we can attain the purposes of turning the page and search the content quickly. Furthermore, the index pocket is used to protect the index card, so that the index card has the functions of resisting water and dirt, preventing damages, and saving materials.

3 Claims, 4 Drawing Sheets

FOLDER INDEX POCKET STRUCTURE

FIELD OF INVENTION

The present invention relates to a document folder structure, more particularly to a folder which includes an index pocket for holding an index card and providing reference to the page numbers for quick inquiry of data and contents in the folder. The index card is movably inserted into a through hole of the index pocket to facilitate a user to hold the index card with a finger, so that the user can insert or remove the index card. This invention can also attain the purposes of resisting water and dirt, preventing damages, and saving materials.

BACKGROUND OF THE INVENTION

Please refer to FIG. 1 for the common folders sold in the market which generally have a label 1 extended from a part of the outer side of the inner page for labeling page numbers, and also providing the information of the contents in the inner page marked with the label 1. Therefore an index page 2 is provided for us to write words or symbols for the corresponding page numbers, and make remarks on the contents recorded in the inner page, and thus attaining the purpose of turning to our desired page more quickly. However, since most of the index pages 2 are placed at the front page of a plurality of loose-leaf pages to facilitate users to turn to their desired page more quickly, therefore such index page 2 may be smudged or even damaged during the process of turning pages. Furthermore, most of such index pages 2 are made of paper and have no waterproof effect, and the index page 2 is usually used as an advertising paper 3. Therefore, after the index page 2 is torn away, the advertising paper 3 will generally become a piece of garbage and thus wasting unnecessary material costs.

In view of the foregoing index page 6 which has many shortcomings, the inventor of this invention improved the prior art by performing many experiments and then finally invented this invention.

SUMMARY OF THE INVENTION

The primary objective of the present invention is to overcome the above deficiencies and avoid the existing shortcomings by providing an folder index pocket structure, which comprises a main body for being used in a folder having a plurality of loose-leaf pages, and such main body is a thin plastic transparent plate and has an index pocket on one side of the main body; a folded edge is disposed at the bottom of the index pocket to receive the index card; and a through hole is disposed on the back cover sheet for letting a user push the index card into and out of the index card pocket by a finger. By means of referring to the marked number on the index card for its corresponding page number, we can attain the purposes of turning to the desired page and search for the content more quickly.

Another objective of the present invention is to provide a folder index pocket for inserting an index card, and such folder index pocket is used to protect the index card, so that the index card can have the functions of resisting water and dirt, preventing damages, and saving material costs.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
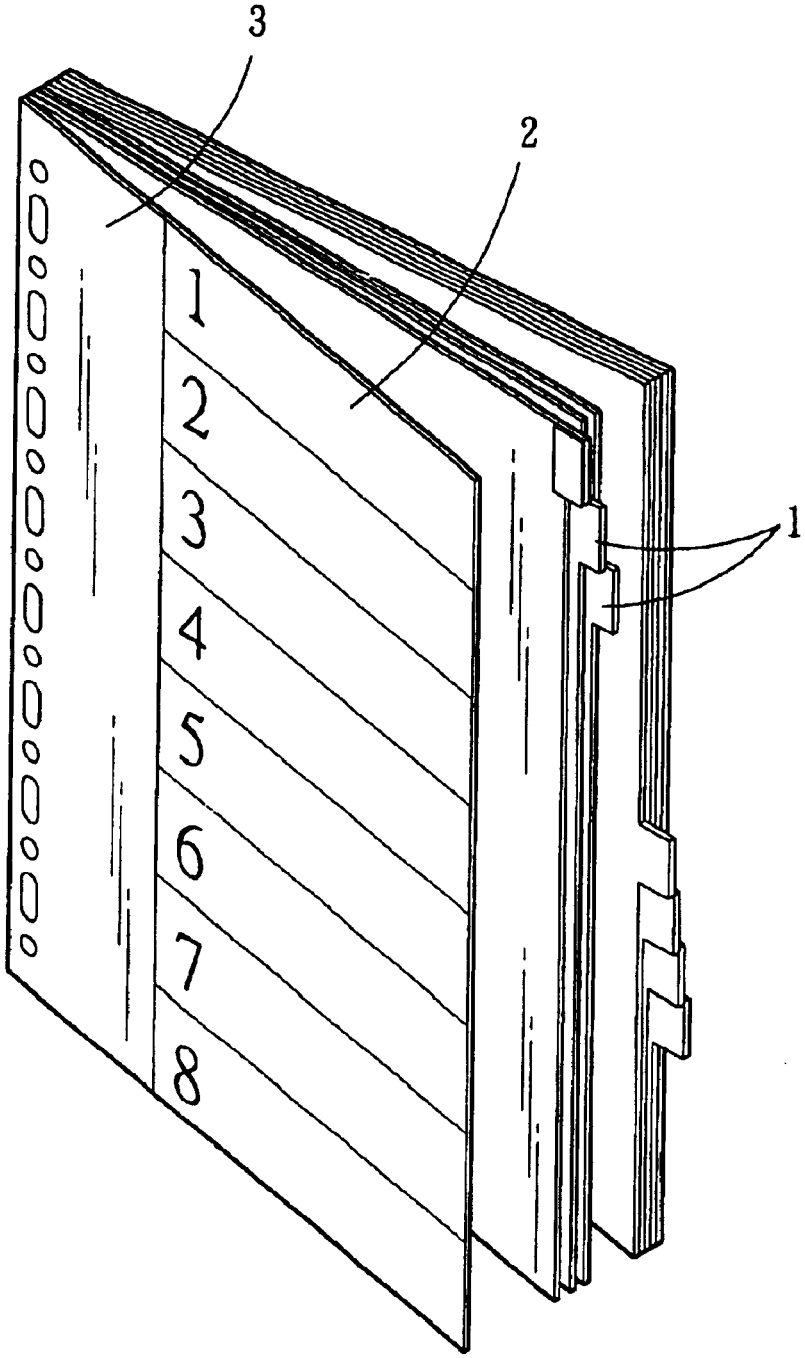
Fig. 1 PRIOR ART
FIG. 1 is an illustrative diagram of a prior-art folder.
Figure 2:
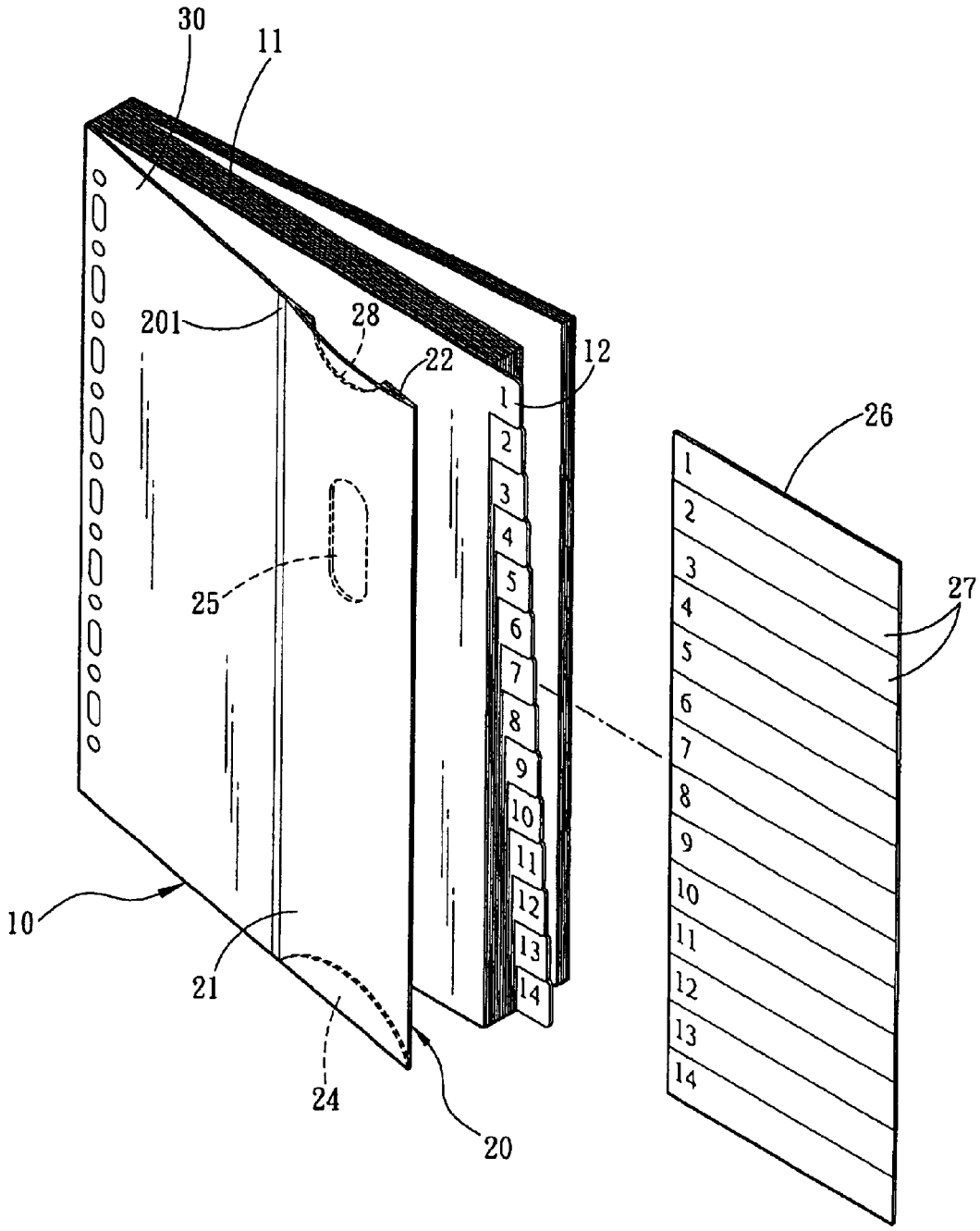
FIG. 2 is a perspective diagram of a preferred embodiment of the present invention.
Figure 3A:
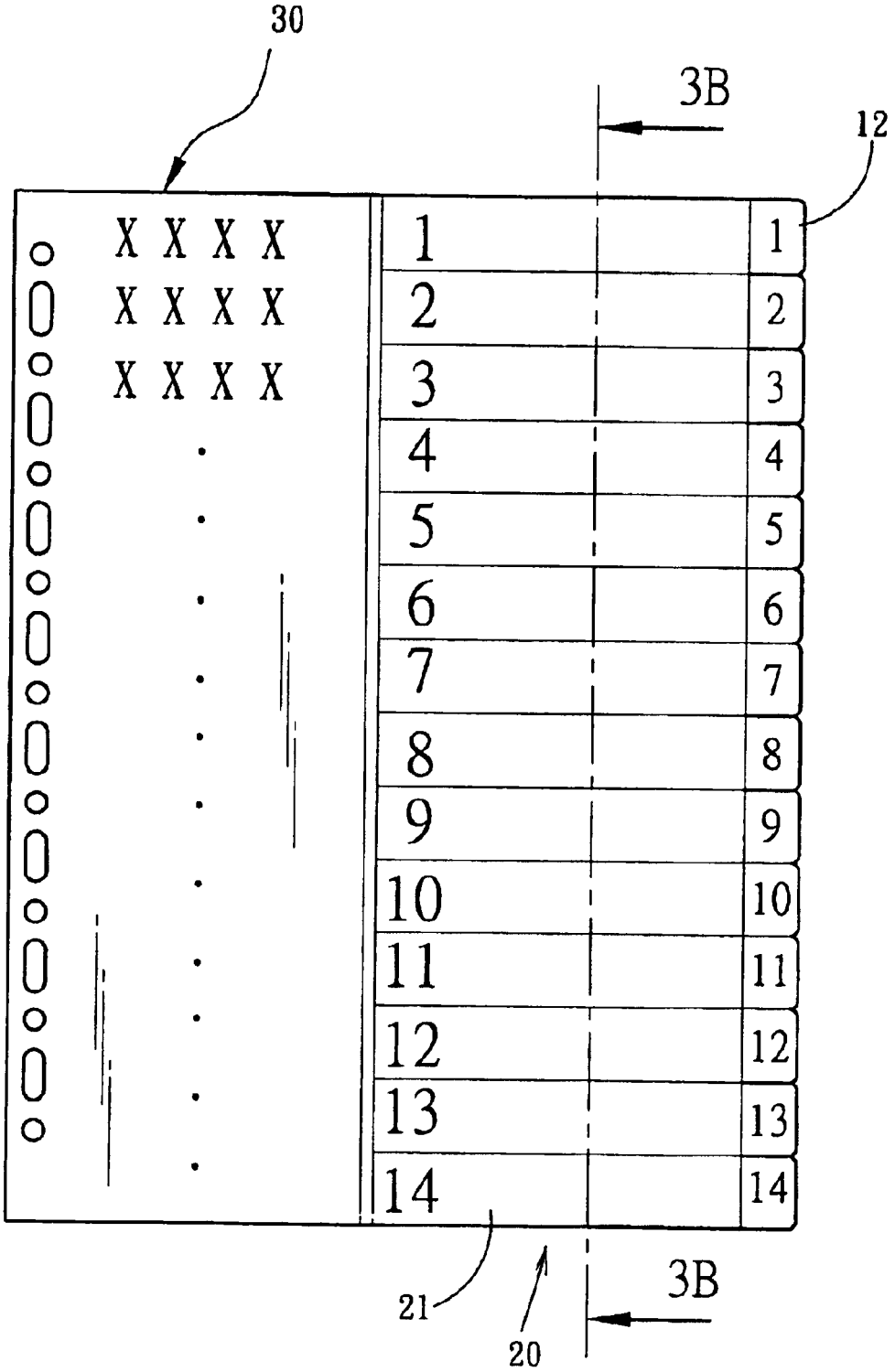
FIG. 3A is a plane diagram of the index pocket according to the present invention.

Referring to FIGS. 2 and 3A which show the folder index pocket structure in accordance with this invention, comprising a main body 30 for being used in a document folder 10 having a plurality of loose-leaf pages 11, and each loose-leaf page 11 has a label 12 extended from its outer side and each label 12 is colored and numbered in sequence; the main body is a thin plastic transparent plate having an index pocket 20, and the index pocket 20 forms a hollow envelop by folding the outer edges of the thin plastic plate inward, and using high-frequency thermal pressure to adhere the outer edge 201 downward to stick the outer edges onto the back of the main body 30. Thus, an index pocket 20 is produced by a two-layered structure with a front cover sheet 21 and a back cover sheet 22 to constitute a hollow envelop. The bottom of the back cover sheet 22 is folded upward to form a folded edge 24 with an appropriate area; a through hole 25 in the longitudinal direction is disposed on the back cover sheet 22; and an indented edge 28 is disposed at the top edge of the back cover sheet 22. By means of the design of the foregoing index pocket 20 structure, a paper index card 26 can be inserted into the index pocket 20, and the index card 26 has the same length with the index pocket 20. The color block 27 with the same width as the label 12 of the loose-leaf page 11 is printed transversally on the index card 26, and the color block 27 is marked with a label number corresponding to the number on the label 12.

Figure 3B:
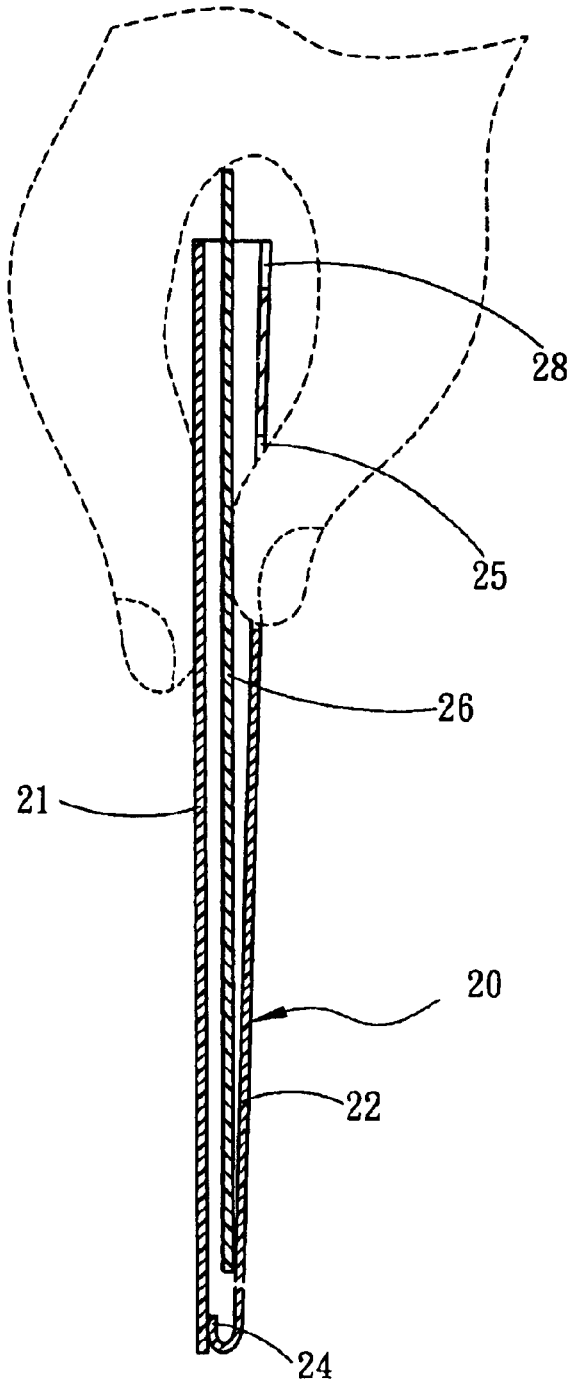
FIG. 3B is a cross-sectional diagram along 3B—3B of FIG. 3A.

Since the index pocket 20 of this invention is a pocket, and has a rectangular through hole 25 on its back cover sheet 22 to facilitate users to insert the soft index card 26 and use a finger to pass through the through hole 25 to push the index card 26 as shown in FIG. 3 until the index card 26 is completely inserted into the index pocket 20. On the other hand, if the user wants t replace the index card with a new one, the old index card must be pulled out first, and a finger is used to pass through the through hole 25 to directly touch and push the index card 26 out. Further, an indented edge 28 is disposed at the top of the back cover sheet 22 of the index pocket 20 to facilitate a user to insert the index card 26 into the interior of the index pocket 20.

Further, in this invention, a folded edge 24 disposed at the bottom of the index pocket is used to hold the bottom of the index card 26, so that the index pocket can prevent the index card 26 from falling out just as a pocket does.

In addition, the index card 26 in accordance with this invention is inserted into a plastic waterproof index pocket 20, so that the index card is separated to prevent the index card from being smudged or damaged by accident during the process of turning pages, and such index pocket 20 also provides a waterproof effect. The size of the index card 26 is corresponsive to the index pocket 26, so that it no longer needs to combine with an advertising sheet (not shown in the figure), and thus effectively saving material costs.

In view of the description above, physical samples according to this invention were made, and tests were passed. The design of such index pocket 20 facilitates users to replace the index card 26, and the back cover sheet 22 having a through hole 25 facilitates users to push the index card into and out of the index pocket 20 with a finger.

The transversal block 27 on the surface of the index card 26 of this invention can be colored and numbered in corresponsive to the color and number of the label 12 of the loose-leaf page in order to allow users to search for the textual contents in the desired loose-leaf page 11.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A folder index pocket structure used for a document folder having a plurality of loose-leaf pages, comprising:

a main body, being a thin transparent plate;

an index pocket, being formed by a front cover sheet and a back cover sheet at one side of said main body, and said index pocket having a folded edge for inserting an index card;

a through hole, disposed at said back cover sheet of said index pocket for letting a user push said index card into and out of said index pocket with a finger; and a number, labeled on said index card corresponding to the labeled number of each loose-leaf page in order to movably replace said index card.

2. The folder index pocket structure of claim 1, wherein said through hole on the back cover sheet of said index pocket is a longitudinal rectangular hole.

3. The folder index pocket structure of claim 1, wherein said index pocket is made of a plastic waterproof material.

* * * * *